US011019935B2

(12) United States Patent
Marson et al.

(10) Patent No.: US 11,019,935 B2
(45) Date of Patent: Jun. 1, 2021

(54) CHANNELIZED INFLATABLE BODIES AND METHODS FOR MAKING THE SAME

(71) Applicant: CASCADE DESIGNS, INC., Seattle, WA (US)

(72) Inventors: James Marson, Seattle, WA (US); Douglas S Jacot, Kingston, WA (US)

(73) Assignee: Cascade Designs, Inc., Seattle, WA (US)

( * ) Notice: Subject to any disclaimer, the term of this patent is extended or adjusted under 35 U.S.C. 154(b) by 947 days.

(21) Appl. No.: 15/116,489

(22) PCT Filed: Sep. 25, 2014

(86) PCT No.: PCT/US2014/057563
§ 371 (c)(1),
(2) Date: Aug. 3, 2016

(87) PCT Pub. No.: WO2015/048359
PCT Pub. Date: Apr. 2, 2015

(65) Prior Publication Data

US 2017/0164759 A1 Jun. 15, 2017

Related U.S. Application Data

(60) Provisional application No. 61/882,622, filed on Sep. 25, 2013.

(51) Int. Cl.

| | |
|---|---|
| ***A47C 27/08*** | (2006.01) |
| ***A47C 27/15*** | (2006.01) |
| ***A47C 27/18*** | (2006.01) |

(52) U.S. Cl.
CPC ..... *A47C 27/081* (2013.01); *A47C 27/084* (2013.01); *A47C 27/088* (2013.01); *A47C 27/15* (2013.01); *A47C 27/18* (2013.01)

(58) Field of Classification Search
CPC ... A47C 27/081; A47C 27/084; A47C 27/088; A47C 27/087; A47C 27/144;
(Continued)

(56) References Cited

U.S. PATENT DOCUMENTS 3,222,697 A * 12/1965 Scheermesser ..... A47C 27/144 297/452.48
3,286,285 A 11/1966 Harvey, Jr.
(Continued)

FOREIGN PATENT DOCUMENTS

CA 2565127 A1 7/1996
CH 704999 A1 11/2012
(Continued)

OTHER PUBLICATIONS

International Search Report and Written Opinion for PCT/US2014/057563, dated Jan. 5, 2015, 9 pages.
(Continued)

*Primary Examiner* — Nicholas F Polito
(74) *Attorney, Agent, or Firm* — BakerHostetler

(57) ABSTRACT

An article of manufacture includes an inflatable body comprising a first core member cut from a single slab of core material and a second core member cut from the single slab of core material and coupled to the first core member.

14 Claims, 10 Drawing Sheets

(58) Field of Classification Search
CPC ..... A47C 27/18; A47G 9/062; A47G 9/086; B63B 7/08; B63B 32/51
See application file for complete search history.

(56) References Cited

U.S. PATENT DOCUMENTS

| | | | | | |
|---|---|---|---|---|---|
| 3,918,110 | A | | 11/1975 | Cantillo et al. | |
| 4,197,342 | A | * | 4/1980 | Bethe | B32B 3/30 428/159 |
| 4,207,636 | A | * | 6/1980 | Ceriani | A47C 27/22 428/101 |
| 4,276,666 | A | * | 7/1981 | Yamada | A47C 27/144 297/DIG. 1 |
| 4,673,452 | A | * | 6/1987 | Awdhan | A47C 27/144 156/254 |
| 5,282,286 | A | | 2/1994 | MacLeish | |
| 5,329,656 | A | * | 7/1994 | Leggett | A47C 27/084 5/420 |
| 5,452,487 | A | | 9/1995 | Leggett | |
| 5,906,019 | A | * | 5/1999 | McCarthy | A47C 27/087 5/706 |
| 5,911,657 | A | * | 6/1999 | Meiners | A47C 4/54 5/655.3 |
| 6,185,770 | B1 | | 2/2001 | Wang | |
| 6,446,289 | B1 | | 9/2002 | Su et al. | |
| 6,463,610 | B1 | | 10/2002 | Shulte et al. | |
| 6,488,153 | B1 | | 12/2002 | Morris | |
| 6,651,277 | B1 | | 11/2003 | Marson | |
| 2004/0163178 | A1 | | 8/2004 | Corneil | |
| 2004/0226100 | A1 | | 11/2004 | Small, Jr. et al. | |
| 2010/0043148 | A1 | | 2/2010 | Rose et al. | |

FOREIGN PATENT DOCUMENTS

| | | | | | |
|---|---|---|---|---|---|
| EP | 0632984 | A1 | | 1/1995 | |
| EP | 1472958 | A1 | * | 11/2004 | A47C 27/088 |
| EP | 1472958 | A1 | | 11/2004 | |
| GB | 2413488 | A | | 11/2005 | |
| WO | WO 1999/066817 | A1 | | 12/1999 | |
| WO | 2009094208 | A2 | | 7/2009 | |

OTHER PUBLICATIONS

Baeumer Germany: "Baeumer EP (Profiling machine)", Jul. 30, 2012, XP054977965, Retrieved from the Internet: URL: https://www.youtube.com/watch?v=e80arVVU8ig [retrieved on Dec. 19, 2017].

European Supplementary Partial European Search Report, EP Application No. 14849685.4, 11 pages.

* cited by examiner

CHANNELIZED INFLATABLE BODIES AND METHODS FOR MAKING THE SAME

BACKGROUND OF THE INVENTION

Current users of portable mattresses such as camping mattresses generally have a choice between highly insulating, self-inflating, mattresses having open cell foam cores, and highly compactable, non-self-inflating air mattresses having complicated film and/or fabric cores. Simple foam core mattresses are inexpensive to manufacture because of the core simplicity, but are comparatively bulky and heavy, while similar class air mattresses are more expensive to manufacture when attempting to achieve comparable thermal efficiencies but are not self-inflating and often fail to achieve thermal efficiency goals.

One approach to decrease weight and increase compactability of foam core mattresses has been to create holes and/or voids in the foam cores of such mattresses. While these holes and/or voids served to decrease bulk and weight while maintaining the benefits of conventional bonded mattresses technologies (e.g., high thermal efficiency and user comfort), the approach was process intensive and/or generating of waste. Examples of such approaches can be found in several self-inflating mattresses that are being of have been sold by Cascade Designs, Inc. such as the CampRest and ProLite mattress pads.

These cored or expanded foam mattresses, when subjected to internal pressures in excess of nominal, self-inflation levels, did not materially increase the mattress thickness over the core thickness. This displacement limiting functionality of the bonded form cores intentionally and beneficially prevent the "balloon effect" commonly found in pure air mattresses.

Finally, even expanded core mattresses used an initial core that was no less than 75% of the planar area of the inflatable mattress of which it would make up. This limitation, in large part, was due to the mechanical limitations of the foam slab used to form the foam core: compliance was needed to "expand" the slits that formed the voids, but too much compliance in the foam resulted in performance degradation at the foam-panel bonds.

DETAILED DESCRIPTION

Figure 1:
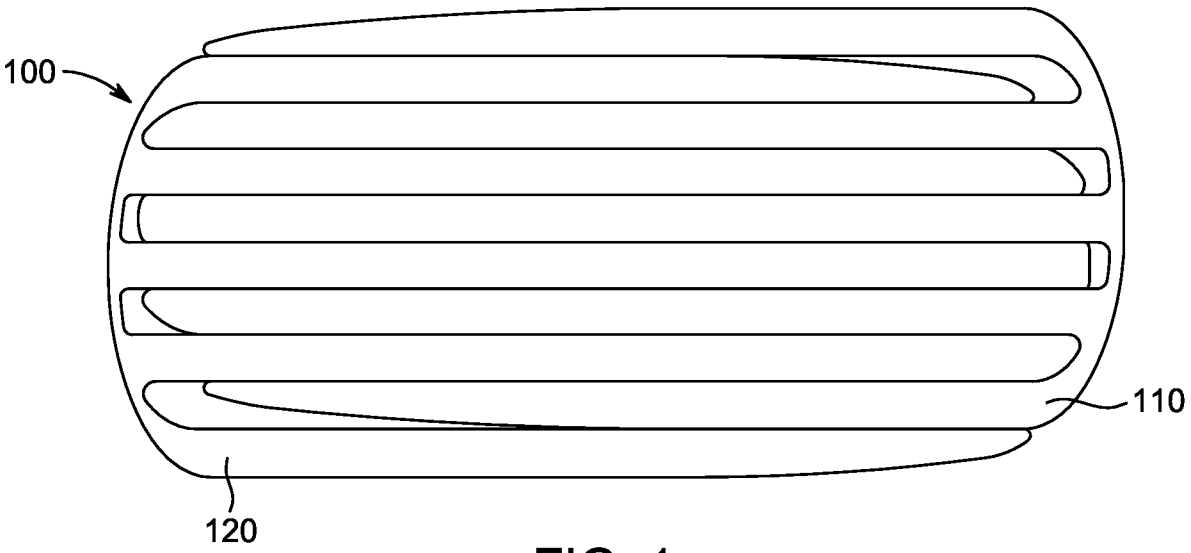
FIG. 1 is a plan view of a resilient foam slab after having been die cut to form two unitary mattress pad cores according to a first embodiment of the invention wherein each core has longitudinal channels extending from an open end to a closed end thereof (for clarity, waste material has been removed)

The invention is directed to hybrid inflatable bodies comprising opposing flexible panel portions sealed at a common perimeter thereof, and having valve means for selectively allowing fluid ingress and egress between the environment and a chamber substantially defined by inner surfaces of the flexible panels. Such inflatable bodies further comprise a core that is selectively bonded to the inner surfaces of the panel portions, characterized in that the bodies have a reduced bonded area to non-bonded area ratios and/or have elongate extending air channels extending through the inflatable body. As used herein, a panel bonded area is that area of a panel that is bonded to the core, which functions as a displacement restraining means or tensile element. For purposes of this disclosure and particularly in this respect, U.S. Pat. No. 3,872,525 issued to Lea, et al. is referenced for background purposes and is incorporated herein by reference. Additionally, elongate extending air channels are characterized as core-free channels bounded, at least in part, by opposing panels of the inflatable body (i.e., non-bonded areas) that extend in a transverse direction (i.e., normal to anticipated user-initiated compressive forces). In many preferred embodiments, the core is comprised of an open cell foam, such as an expanded or foamed polyurethane.

The reduced panel bonded area characteristics of various invention embodiments may be achieved through the use of channelized cores. Channelization in some embodiments comprises deriving two unitary cores from a single slab of core material such as foam, and in other embodiments channelization comprises deriving non-unitary cores from a single half slab of core material, while in still other embodiment channelization comprises deriving at least one unitary core and at least one part of a non-unitary core from a single slab of core material (as well as several non-unitary cores in addition to the unitary core). As used herein, the term "non-unitary" means a core structure comprising a plurality of discrete core elements that, when integrated into an inflatable body, constitute a singular core.

For embodiments wherein a single slab yields two unitary cores, a preferred core geometry is one characterized as having a root or spine portion from which extend a plurality of ribs, wherein the ribs partially define future elongate extending air channels when the core is integrated with the opposing panel portions, as previously described. By slitting or otherwise cutting such a core from a slab, it is possible to create a second core by limiting the distance of rib extensions, i.e., prior to reaching the opposing side of the slab. In this case, removal of the ribs from a first core from the slab forms the channels of a second core and vice versa. The result is a pair of cores that have three substantially contiguous sides and a highly variegated side (i.e., the rib terminating side or side opposite the root/spine—hereinafter "the terminal side"). Since symmetry is preferred about the medial sagittal plane (lateral symmetry), the ribs preferably extend longitudinally in an elongate inflatable body, which then places the root/spine-terminal side asymmetry in the longitudinal direction. In the art of mattress pads, the terminal side may advantageously form an integrated pillow for a user, for reasons that will be described in greater detail below.

For embodiments wherein a half slab yields a single core, a preferred geometry is one characterized as having a mirrored geometry, such as a medial sagittal plane mirror (laterally symmetrical). In such embodiments, a root/spine and rib arrangement is created, however, the direction of rib extension in the core is preferably lateral as opposed to longitudinal if the slab is not symmetrical in both x and y axes, and by implication, the root/spine extends longitudinally. In some embodiments, the root/spines are centrally (medially) located within the inflatable body while in other embodiments, they are peripherally (laterally) located.

The use of channelized foam cores not only results in inflatable bodies having decreased densities over equivalent sized conventional foam core self-inflating bodies, but also notable increases compactability. Moreover, the presence of elongate extending air channels permits localized "ballooning" of the opposing panel portions, thereby increasing the sectional thickness of the inflatable body thereat, and often time perceived user comfort. Because this ballooning effect is only present at the air channels, which are necessarily at least partially defined by the foam core, their location, frequency, geometry (rectilinear, curvilinear, or combinations thereof), the characteristics of each air channel can all be precisely established. With respect to the variegated side of certain foam core embodiments, the comparatively unbonded portion of the inflatable body thereat will balloon to a greater degree than other perimeter portions of the inflatable body and conveniently form a pillow-like structure.

Because a comparatively large portion of the opposing panels are not bonded to the foam core in view of the prior art, which results in material panel distension, the edges of the foam cores-panel interfaces thereat are subjected to greater shear or peeling forces. Additionally, the previously noted ballooning effect imparts greater tension forces in the foam care, particularly adjacent to the elongate extending air channels. As a consequence, a high tensile strength open cell foam material is preferably used and/or consideration is given to core thickness versus channel widths.

To increase the thermal performance of inflatable bodies according to the invention embodiments, the inner surfaces of the panels that form the inflatable body can be aluminized or otherwise treated with a radiant energy reflective treatment. Additionally, serpentine films or "gapped" films can be disposed between the foam core and panels to decrease convective heat transfer. These films can also be treated with a radiant energy reflective treatment to further limit radiant heat transfer.

For purposes of this patent, the terms "area", "boundary", "part", "portion", "surface", "zone", and their synonyms, equivalents and plural forms, as may be used herein and by way of example, are intended to provide descriptive references or landmarks with respect to the article and/or process being described. These and similar or equivalent terms are not intended, nor should be inferred, to delimit or define per se elements of the referenced article and/or process, unless specifically stated as such or facially clear from the several drawings and/or the context in which the term(s) is/are used.

FIG. 1 is a plan view of a resilient foam slab 100 after having been die cut to form two unitary mattress pad cores 110, 120 according to a first embodiment of the invention (for clarity, waste material produced in forming the pad cores is not illustrated).

Figure 2:
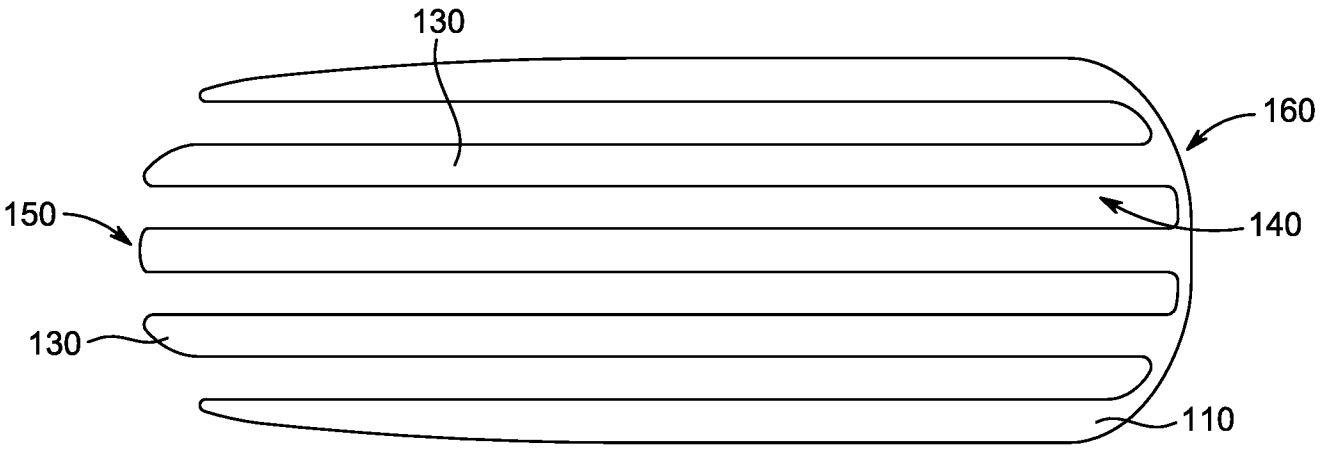
FIG. 2 is a plan view of one of the two mattress pad cores established in FIG. 1.

FIG. 2 is a plan view of a pad core 110 produced from the slab 100 illustrated in FIG. 1. Core 110 has longitudinal ribs 130 defining channels 140 extending from an open end 150 to a closed end 160 thereof.

Figure 3:
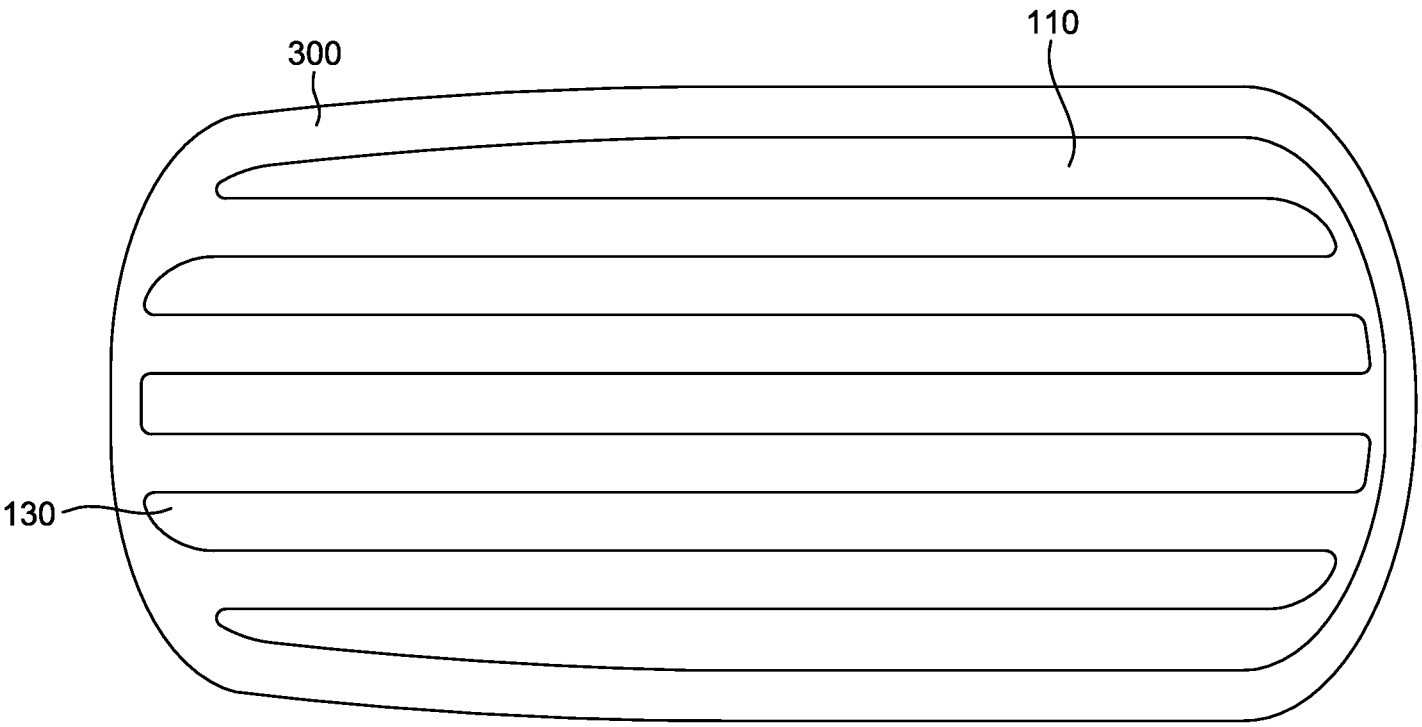
FIG. 3 shows the core of FIG. 2 within an envelope defined by an inflatable body, wherein the facing surfaces of the core have been adhesively bonded to the inner surfaces of the envelope (for clarity, only the perimeter of the inflatable body is shown)

FIG. 3 shows the core 110 of FIG. 2 within an envelope 300 defined by an inflatable body, wherein the ribs 130 of the core have been adhesively bonded to the inner surfaces of the envelope (for clarity, only the perimeter of the inflatable body is shown).

Figure 4:
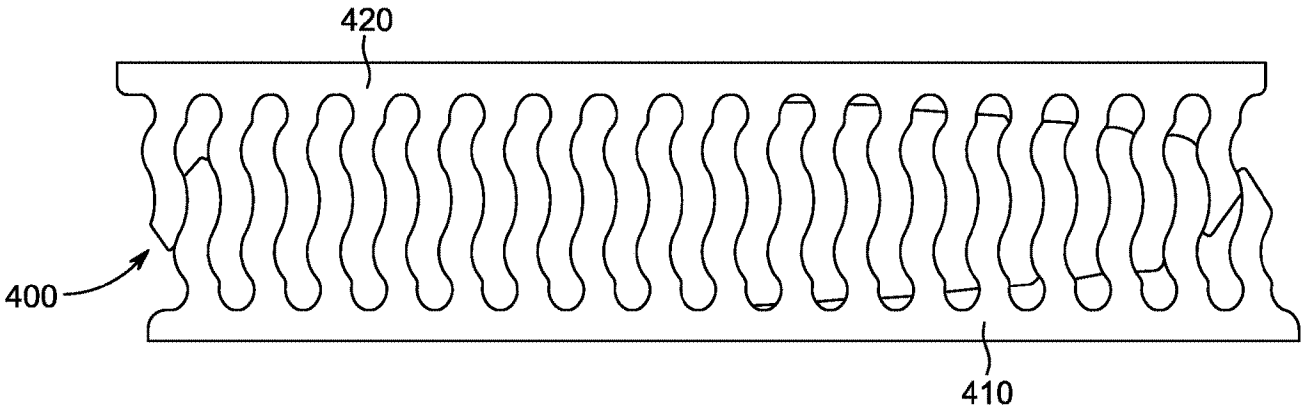
FIG. 4 is a plan view of a resilient foam slab after having been die cut to form a single non-unitary mattress pad core according to a second embodiment of the invention, wherein each half core has lateral channels extending from a lateral open side to a closed medial side thereof when the cores are configured and assembled for use (for clarity, waste material has been removed)

FIG. 4 is a plan view of a resilient foam slab 400 after having been die cut to form two half cores 410, 420 used to assemble a single non-unitary mattress pad core 500 (FIG. 5) according to a second embodiment of the invention (for clarity, waste material produced in forming the pad cores is not illustrated).

Figure 5:
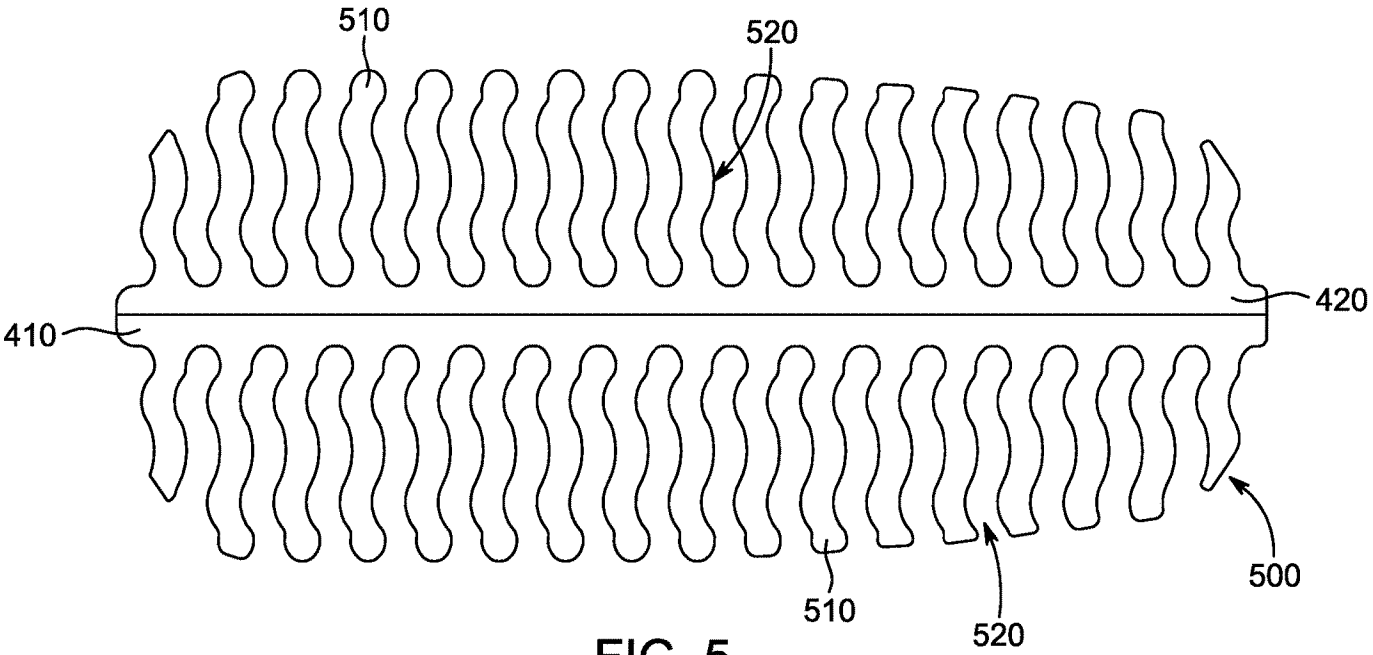
FIG. 5 is a plan view of the non-unitary core of FIG. 4 when the two halves are configured and assembled for use, particularly by positioning the closed medial sides of the half cores adjacent to each other.

FIG. 5 is a plan view of core 500 when the two half cores 410, 420 are configured and assembled for use, particularly by positioning the closed medial sides (edges) of the half cores adjacent to each other. Each half core 410, 420 has lateral sinusoidal ribs 510 defining channels 520 extending from a lateral open side to a closed medial side thereof when the cores are configured and assembled for use.

Figure 6:
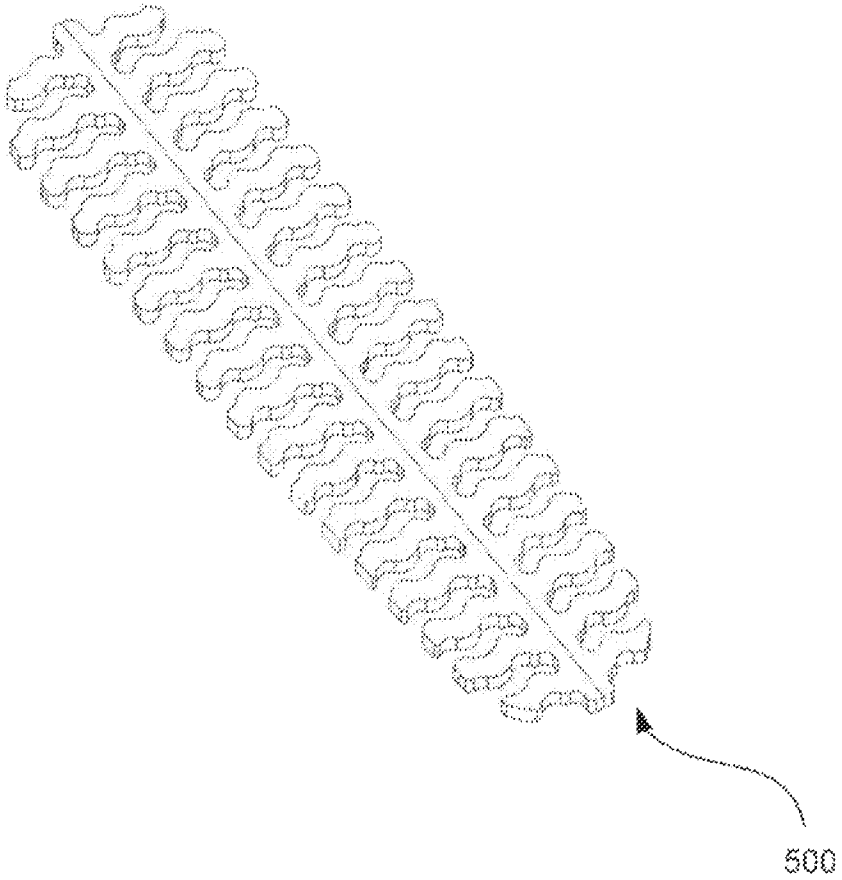
FIG. 6 is a perspective view of the configured and assembled core shown in FIG. 5.

FIG. 6 is a perspective view of the configured and assembled core shown in FIG. 5.

Figures 7, 8:
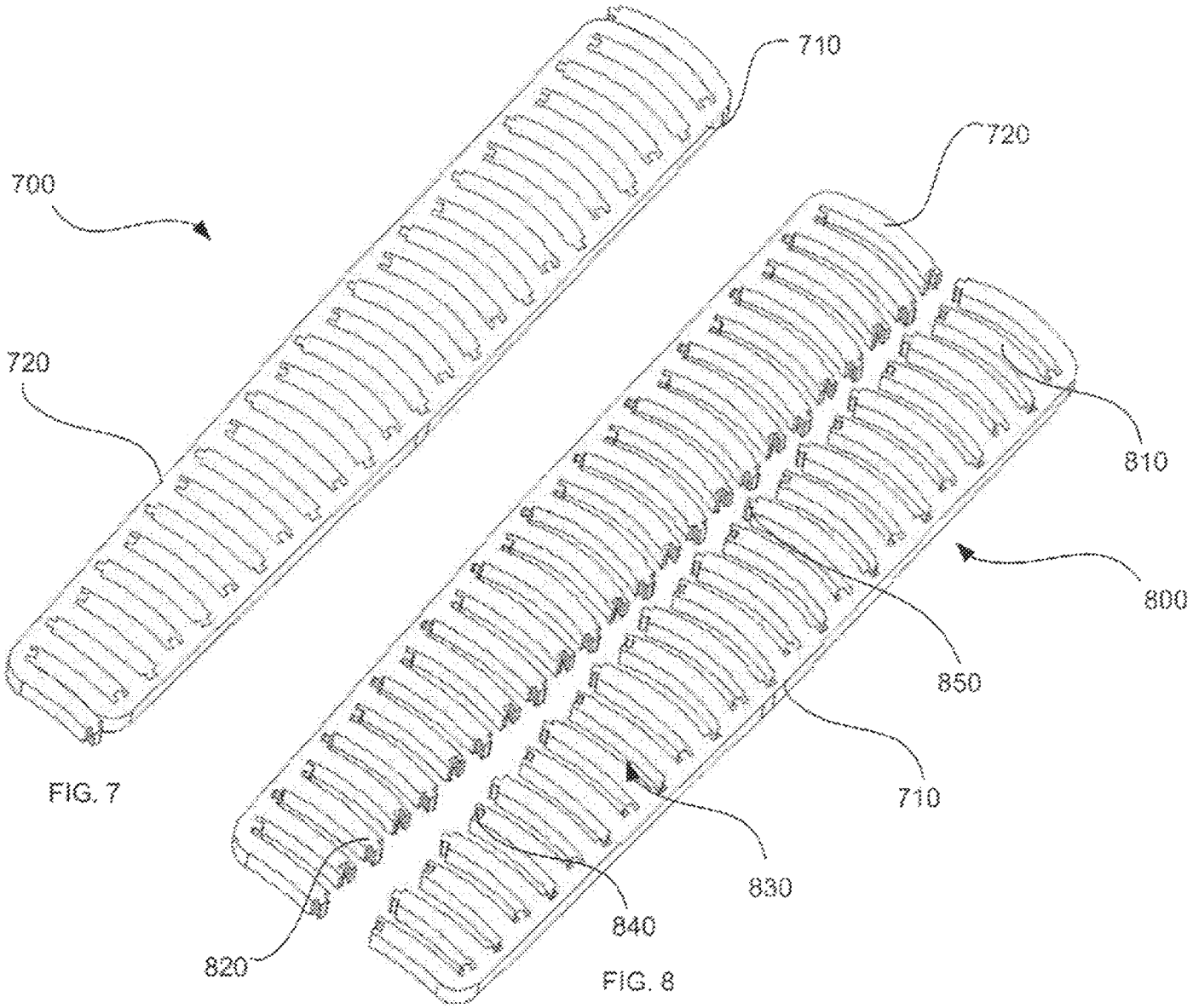
FIG. 7 is a generally plan view of a resilient foam slab after having been die cut to form a single non-unitary mattress pad core according to a third embodiment of the invention, wherein each half core has lateral channels extending from a medial open side to a closed lateral side thereof when the cores are configured and assembled for use (for clarity, waste material has been removed)
FIG. 8 is a generally plan view of the non-unitary core of FIG. 7 when the two halves have been separated and just prior to linkage of the ribs that define the lateral channels.

FIG. 7 is a perspective view of a resilient foam slab 700 after having been die cut to form two half cores 710, 720 used to assemble a single non-unitary mattress pad core 800

(FIG. 8) according to a third embodiment of the invention, (for clarity, waste material produced in forming the pad cores is not illustrated).

FIG. 8 is an exploded perspective view of a non-unitary core 800 when the two half cores 710, 720 of FIG. 7 have been separated and just prior to linkage of the ribs 810, 820 that define lateral channels 830 extending from a medial open side to a closed lateral side thereof when the cores are configured and assembled for use. Ribs 810, 820 include recessed female portions 840 and male portions 850. Male portion 850 is configured to couple with a corresponding female portion 840.

Figure 9:
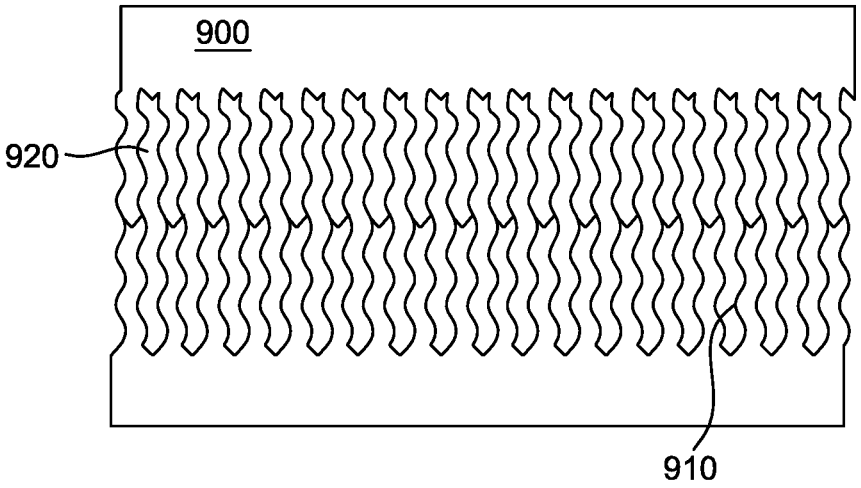
FIG. 9 illustrates an alternative geometry to that of FIGS. 7 and 8 wherein the ribs (and consequently the channels) have a sinusoidal form.

FIG. 9 illustrates an alternative-geometry pad core 900 formed from a unitary foam slab, the ribs 910 (and consequently the channels 920) of which have a sinusoidal form.

Figure 10:
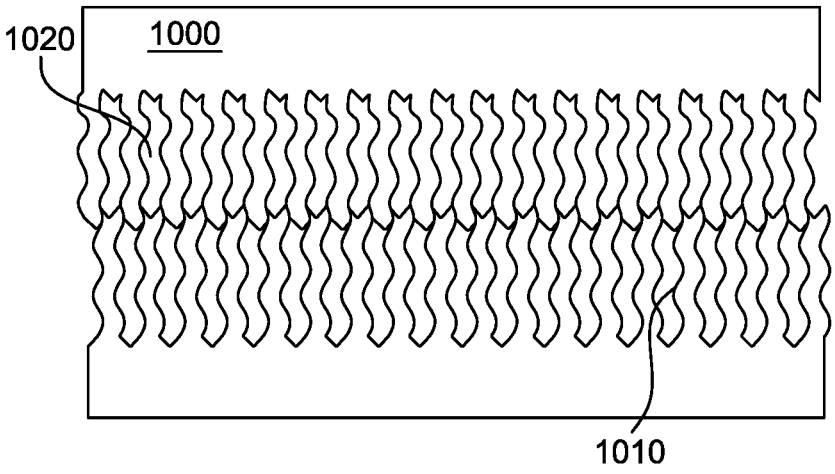
FIG. 10 illustrates an alternative geometry to that of FIGS. 7 and 8 wherein the ribs (and consequently the channels) have a sinusoidal form but differs from that of FIG. 9 insofar as the channels formed by the ribs do not extend from one lateral side to the other lateral side.

FIG. 10 illustrates an alternative-geometry pad core 1000 formed from a unitary foam slab, the ribs 1010 (and consequently the channels 1020) of which have a sinusoidal form. Core 1000 differs from core 900 insofar as the channels 1020 formed by the ribs 1010 do not extend from one lateral side to the other lateral side.

Figure 11:
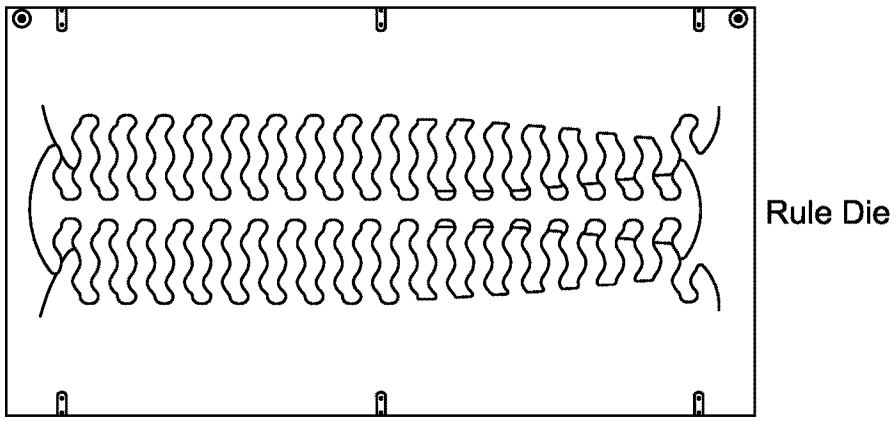
FIG. 11 is a plan view of a rule dies for creating a fourth embodiment of the invention, whereby a unitary mattress core is created from a single slab of core material in addition to partial cuts for two other unitary mattress cores or two half cores for a non-unitary mattress core.

FIG. 11 is a plan view of a rule dies for creating a fourth embodiment of the invention, whereby a unitary mattress core is created from a single slab of core material in addition to partial cuts for two other unitary mattress cores or two half cores for a non-unitary mattress core.

Figure 12:
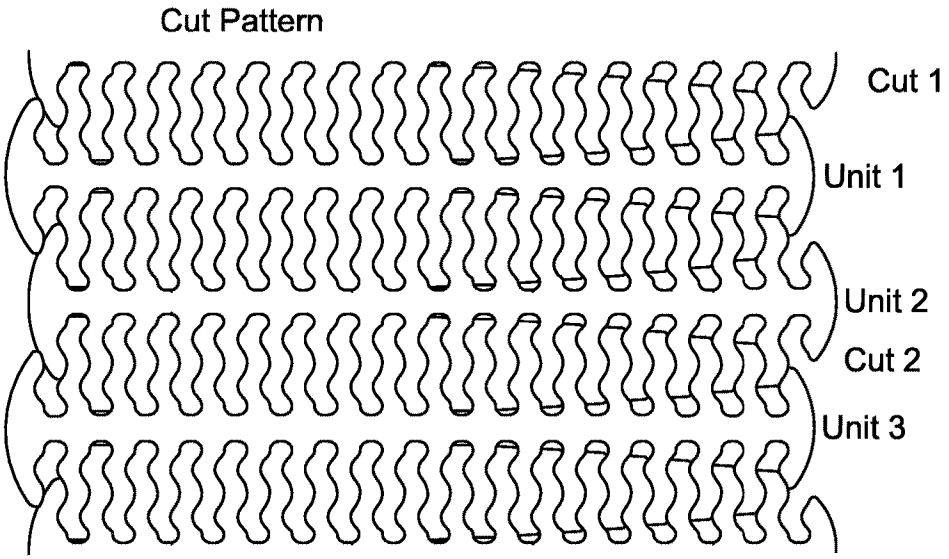
FIG. 12 shows the resulting cut pattern of the rule die of FIG. 11 when applied to either a single slab of core material and twice cut to form three unitary cores and two half cores, or to two slabs of core material and each single cut to yield two unitary cores and two non-unitary cores.

FIG. 12 shows the resulting cut pattern of the rule die of FIG. 11 when applied to either a single slab of core material and twice cut to form three unitary cores and two half cores, or to two slabs of core material and each single cut to yield two unitary cores and two non-unitary cores.

Figure 13:
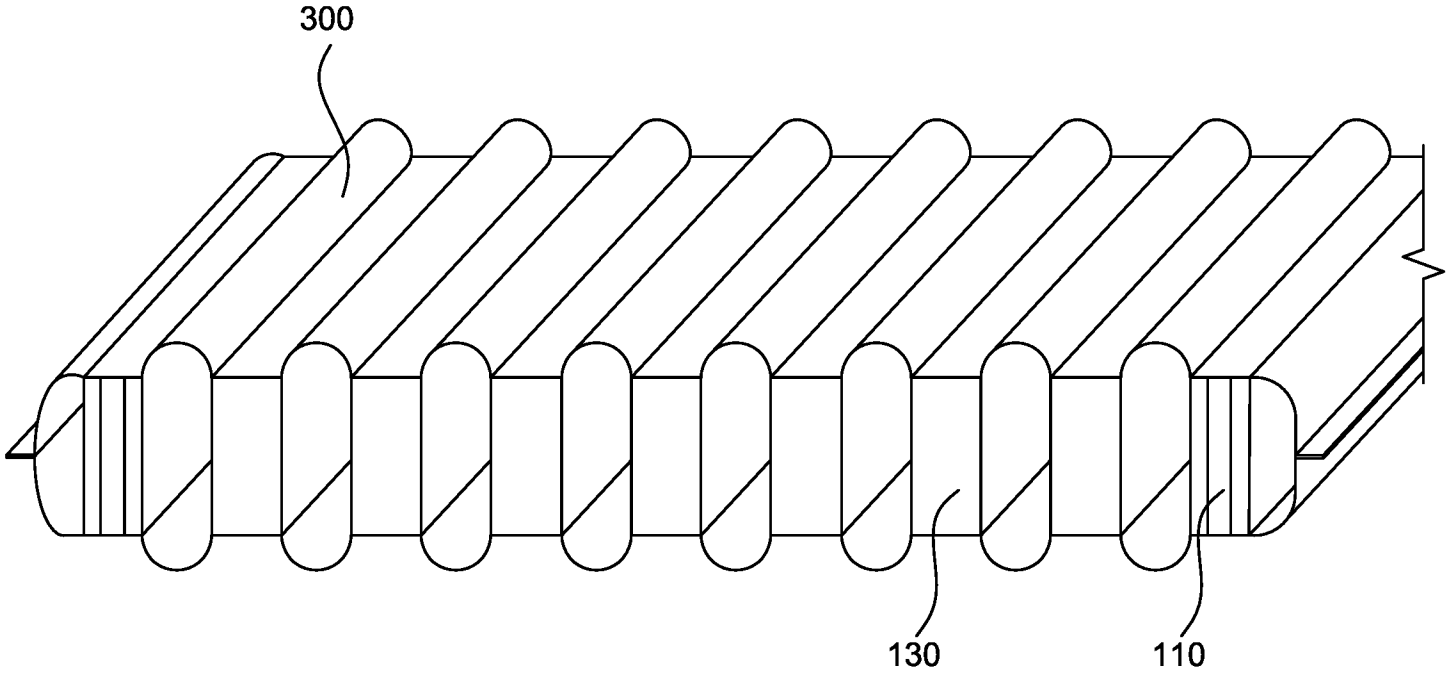
FIG. 13 is a cross section in perspective of an inflatable mattress according to the first embodiment and generally shown in FIG. 3, wherein the unbonded panels comprising the envelope of the inflatable body are allowed to displace upon inflation of the body.

FIG. 13 is a cross section in perspective of an inflatable mattress according to the first embodiment and generally shown in FIG. 3, wherein the unbonded panels comprising the envelope of the inflatable body are allowed to displace upon inflation of the body.

Figure 14:
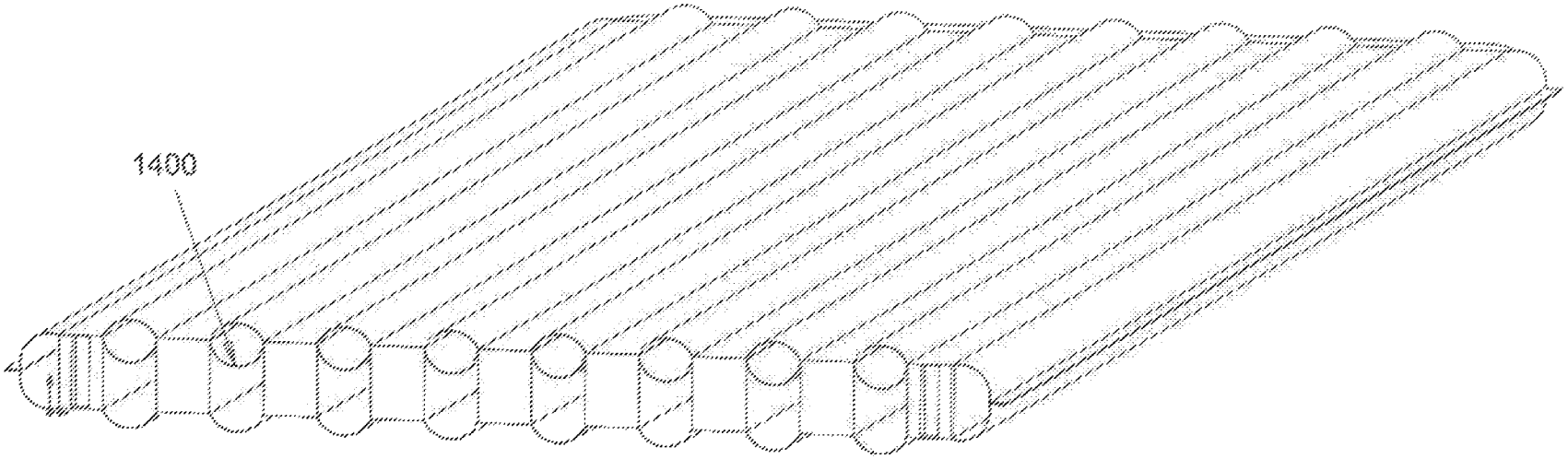
FIG. 14 shows a derivative embodiment to that of FIG. 13 wherein a thermal film barrier is established intermediate the outer panel and the inner channel, and is kept open at an end of the mattress for proper inflation to form a gapped barrier.

FIG. 14 shows a derivative embodiment to that of FIG. 13 wherein a thermal film barrier 1400 is established intermediate the outer panel and the inner channel, and is kept open at an end of the mattress for proper inflation to form a gapped barrier.

Figure 15:
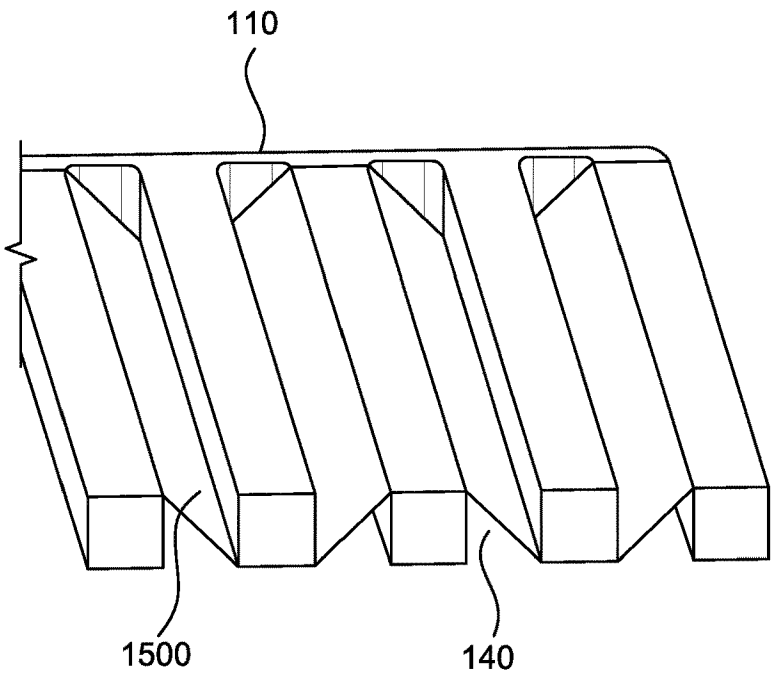
FIG. 15 illustrates a construction step for introducing a serpentine metalized film within the channels defined by the mattress core.

FIG. 15 illustrates a construction step for introducing a serpentine metalized film 1500 within the channels 140 defined by the mattress core 110.

Figure 16:
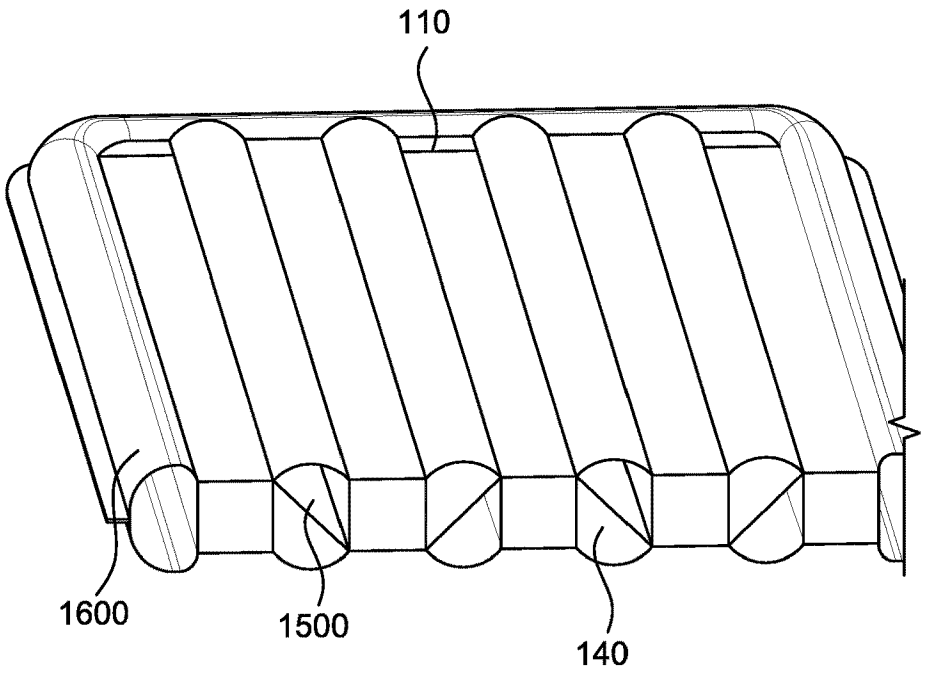
FIG. 16 illustrates a construction step subsequent to that of FIG. 15, wherein the outer panels that comprise the mattress envelope are adhered to the core and film to form bi-layer channels.

FIG. 16 illustrates a construction step subsequent to that of FIG. 15, wherein the outer panels 1600 that comprise the mattress envelope are adhered to the core 110 and film 1500 to form bi-layer channels 140.

It will be apparent to those skilled in the art that various modifications and variations can be made in the present invention without departing from the spirit or scope of the invention. Thus, it is intended that the present invention cover the modifications and variations of the invention provided they come within the scope of the appended claims and their equivalents.

What is claimed:

1. An inflatable body, comprising:

an envelope; and a core bonded to the envelope, the core including a first core member and a second core member, wherein the first core member includes a first plurality of elongated ribs, wherein each rib among the first plurality of elongated ribs extends in a first horizontal direction, wherein the first plurality of elongated ribs define first channels between each rib that extend from a first lateral open side to a first closed medial side, and wherein the second core member includes a second plurality of elongated ribs, wherein each rib among the second plurality of elongated ribs extends in a second horizontal direction opposite the first horizontal direction, wherein the second plurality of elongated ribs define second channels between each rib that extend from a second lateral open side to a second closed medial side, and wherein the first closed medial side of the first core member is positioned adjacent to the second closed medial side of the second core member so as to define a plane parallel to a sleeping surface.

2. The article of claim 1, wherein each rib in the first plurality of elongated ribs are commonly connected at the first closed medial side and each rib is separated at the first lateral open side and each rib in the second plurality of elongated ribs are commonly connected at the second closed medial side and each rib is separated at the second lateral open side.

3. The article of claim 2, wherein the first closed medial side and second closed medial side contact one another to define a common spine.

4. The article of claim 1, wherein each rib among the first plurality of elongated ribs and each rib among the second plurality of elongated ribs has a sinusoidal form.

5. The article of claim 1, wherein the first plurality of elongated ribs are spaced to form the first channels between adjacent ribs and the second plurality of elongated ribs are spaced to form the second channels between adjacent ribs, and wherein the first plurality of ribs are configured to fit within the second channels and the second plurality of ribs are configured to fit within the first channels prior to the first closed medial side being positioned adjacent to the second closed medial side.

6. The article of claim 1, wherein the first core member and second core member are cut from a single piece of core material.

7. The article of claim 1, further comprising a film bonded to at least a portion of the core to reduce one of thermal radiant heat transfer, thermal convective heat transfer or both thermal radiant and convective heat transfer.

8. A method of constructing an inflatable body, the method comprising the steps of:

cutting a first core member comprising a first plurality of elongated ribs, wherein each rib among the first plurality of elongated ribs extends in a first horizontal direction, wherein the first plurality of elongated ribs define first channels between each rib that extend from a first lateral open side to a first closed medial side;

cutting a second core member comprising a second plurality of elongated ribs, wherein each rib among the second plurality of elongated ribs extends in a second horizontal direction opposite the first horizontal direction, wherein the second plurality of elongated ribs define first channels between each rib that extend from a first lateral open side to a first closed medial side;

positioning the first closed medial side of the first core member adjacent to the second closed medial side of the second core member so as to define a plane parallel to a sleeping surface; and bonding an envelope to at least a portion of the first core member and the second core member.

9. The method of claim 8, wherein each rib in the first plurality of elongated ribs are commonly connected at the first closed medial side and each rib is separated at the first lateral open side and each rib in the second plurality of elongated ribs are commonly connected at the second closed medial side and each rib is separated at the second lateral open side.

10. The method of claim 9, wherein the first closed medial side and second closed medial side contact one another to define a common spine.

11. The method of claim 9, wherein each rib among the first plurality of elongated ribs and each rib among the second plurality of elongated ribs has a sinusoidal form.

12. The method of claim 9, wherein the first plurality of elongated ribs are spaced to form the first channels between adjacent ribs and the second plurality of elongated ribs are spaced to form the second channels between adjacent ribs, and wherein the first plurality of ribs are configured to fit within the second channels and the second plurality of ribs are configured to fit within the first channels prior to the first closed medial side being positioned adjacent to the second closed medial side.

13. The method of claim 9, wherein the first core member and second core member are cut from a single piece of core material.

14. The method of claim 9, the method further comprising bonding a film to at least a portion of the first core member and the second core member to reduce one of thermal radiant heat transfer, thermal convective heat transfer or both thermal radiant and convective heat transfer.

* * * * *